United States Patent [19]

Morris

[11] Patent Number: 4,475,057

[45] Date of Patent: Oct. 2, 1984

[54] CRT ARTICLE OF MANUFACTURE AND PROCESS THEREFORE

[75] Inventor: Thomas J. Morris, Addison, Ill.

[73] Assignee: Zenith Electronics Corporation, Glenview, Ill.

[21] Appl. No.: 335,117

[22] Filed: Dec. 28, 1981

[51] Int. Cl.[3] ..... H01J 9/50; H01J 9/20

[52] U.S. Cl. ..... 313/461; 445/6; 445/2; 358/220; 315/381

[58] Field of Search ..... 445/2, 5, 6; 358/220; 315/381; 313/461

[56] References Cited

U.S. PATENT DOCUMENTS

| | | | |
|---|---|---|---|
| 3,255,309 | 6/1966 | Rudert . | |
| 3,335,220 | 8/1967 | Wilcox . | |
| 3,366,434 | 1/1968 | Mengel | 445/2 |
| 4,127,796 | 11/1978 | Henderson | 358/220 |
| 4,130,830 | 12/1978 | Derickson | 358/220 X |
| 4,275,338 | 6/1981 | Grocki et al. | 315/381 |
| 4,395,243 | 7/1983 | Toyama et al. | 445/6 |

*Primary Examiner*—Kenneth J. Ramsey
*Attorney, Agent, or Firm*—Cornelius J. O'Connor

[57] ABSTRACT

An article of manufacture is disclosed comprising a cathode ray tube having a glass face panel with a cathodoluminescent screen on the inner surface thereof. The screen has a phosphor constituent vulnerable to patterned discoloring known as character burn. Character burn is caused by static area electron bombardment of such time and intensity as to discolor the phosphor, but not appreciably degrade phosphor efficiency. The tube according to the invention is characterized by having a conditioned screen uniformly burn-discolored throughout at least in the visible portion of the screen to render substantially imperceptible patterned character burn resulting from use. A process is also disclosed for use in the manufacture of cathode ray tubes and display monitors, and the reclamation of character-burned cathode ray tubes to render character burn substantially imperceptible.

9 Claims, 5 Drawing Figures

CRT ARTICLE OF MANUFACTURE AND PROCESS THEREFORE

BACKGROUND OF THE INVENTION AND PRIOR ART STATEMENT

This invention relates generally to video displays and television picture displays utilizing the cathode ray tube, and is particularly concerned with establishing and maintaining image quality in such displays.

Cathode ray tubes used in alphanumeric displays typically have a glass face panel with a cathodoluminescent screen on the inner surface thereof. Typically, numbers, letters, characters or symbols are generated in alphanumeric displays and presented on the screen in a very precise dot matrix, or "character block" format. For example, a five dot by seven dot character is generated within a seven dot by nine dot character block. In the seven-by-nine matrix, there are 63 discrete dots available for forming each character. For maximum image discernibility, the cathode ray tube forming the image is typically driven to provide very high contrast. The precise timing of the scanning circuits ensures that the discrete dots are located at the exact same points on the screen.

The cathode ray tube screen has a phosphor constituent vulnerable to patterned discoloring known as "character burn." Character burn is caused by static area electron bombardment of such time and intensity as to discolor the phosphor, but not appreciable degrade phosphor efficiency. For example, the repeated exciting of the phosphor at the same location within the respective character blocks can result in character burn. This discoloring is manifested as a browning of the screen of monochromatic tubes, for example, with a browning in the localized area varying in darkness depending upon the frequency of use of the particular character. For example, those character blocks which experience more use than others, such as the characters e, t, o, i and n, will show darker discoloration than others which appear less often. Character burn may appear very quickly; e.g., after a few hours of use.

The effect of character burn is, in essence, a cosmetic one in which the screen exhibits an undesired mottling which can result in customer complaints.

The type of discoloring resulting from character burn is normally not visible on the screen of a standard television picture display, in which all areas of the screen are scanned relatively uniformly. However, for example, if the television display is used for prolonged period of time with a video game having stationary boundary lines, the lines may become perceptible as a patterned brown discoloring of the screen.

Character burn, as it will be referred to hereafter, is distinguished from "phosphor burn," in that phosphor burn is considered to be an irreversible condition resulting from over-excitation of the phospor due to a very high beam current. High beam current can be the result of a fault in the voltage control circuit of the high voltage power supply. The effect is a deterioration in phosphor efficiency to such an extent that there is little or no light output from the burned areas when the screen is excited.

The prior art is directed primarily to means for causing the image on the cathode ray tube face plate to move imperceptibly and thus prevent phosphor burn. Henderson in U.S. Pat. No. 4,127,796 set forth means for superimposing or adding to the beam deflecting voltages an additional triangular waveform. The combined effect of the offset waveforms is said to be such as to constantly move the entire picture tube electron scan patttern over an infrequently recurring path at a slow enough rate to be imperceptible to the viewer. Rudert in U.S. Pat. No. 3,255,309 discloses means operable to produce a periodic deflection of electrons emitted from a camera tube photo-cathode, with the periodicity of the deflection being long in relation to the periodicity of field deflection. Wilcox, in U.S. Pat. No. 3,335,220 discloses a camera tube target protection system employing a varying raster size to prevent phosphor burn.

In U.S. Pat. No. 4,198,661, Gatten et al discloses electrical circuits for preventing burn spots in the CRT phosphor. In one embodiment of the invention, the absolute value of the rate of change of deflection of the beam as measured by horizontal and vertical yoke current is divided by the brightness level of the beam to produce a signal which is compared to a reference value. If the dividend exceeds the reference value, the cathode ray tube is shut down by blanking the CRT beam.

OBJECTS OF THE INVENTION

It is a general object of this invention to provide for a uniform appearance of cathode ray tube screens.

It is a less general object to provide for the preconditioning of cathode ray tubes to ameliorate the effects of character burn.

It is another less general object to provide for the reclamation of cathode ray tubes exhibiting character burn.

It is a specific object of the invention to render substantially imperceptible the mottling of the screen resulting from character burn.

It is another specific object of this invention to provide an article of manufacture comprising a cathode ray tube having a cathodoluminescent screen conditioned to render character burn substantially imperceptible.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
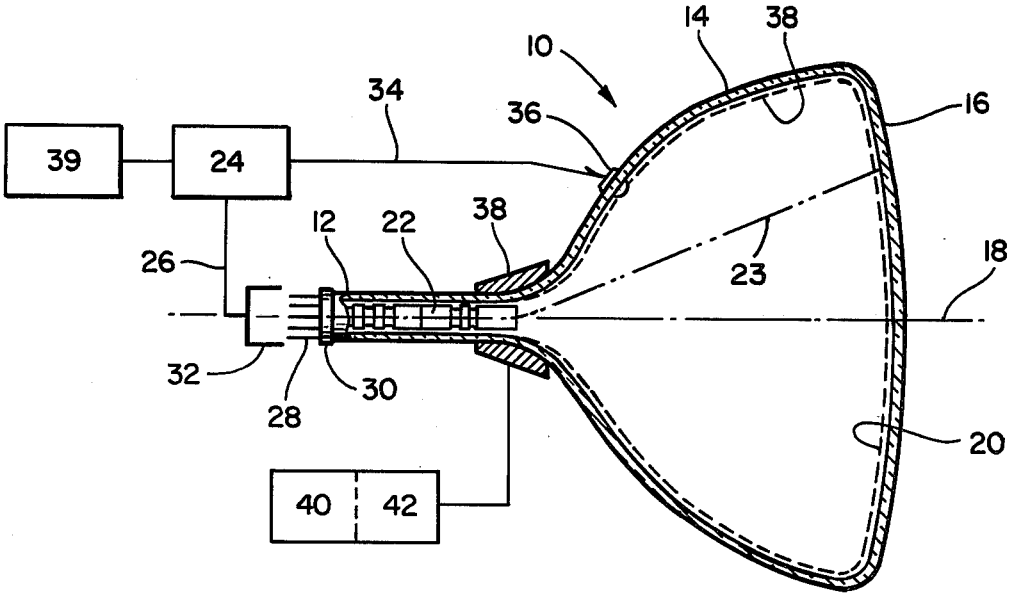
PRIOR ART Fig. 1
FIG. 1 is a longitudinal view in section of a cathode ray picture tube with ancillary components and circuits indicated schematically.

The process according to the invention is for use in the manufacture or reclamation of a cathode ray tube of the well-known type depicted in FIG. 1. Tube 10 can be used for a video monitor display or as a picture tube in a conventional television receiver.

Tube 10 essentially comprises an envelope having a neck 12, a funnel 14 and a glass face panel 16 oriented on the axis 18 of tube 10. Tube 10 has a cathodoluminescent screen 20 that emits light of one color deposited on the inner surface of face panel 16. Screen 20 has a phosphor constituent vulnerable to a patterned discoloring known as character burn caused by static area electron bombardment of such time and intensity as to discolor the phosphor, but not appreciably degrade phosphor efficiency.

Tube 10 includes an electron gun 22, indicated as being a single gun emitting a single electron beam 23 for bombarding cathodoluminescent screen 20.

Ancillary circuits and components for actuating and controlling the operation of tube 10 include a power supply 24 which supplies low and intermediate voltages through a plurality of electrical conductors represented schematically by conductor 26 which enter the envelope of tube 10 through ones of a plurality of lead-in pins 28 in the base 30 of tube 10. Electrical connection to pins 28 is made by means of a socket 32. The relatively high voltage for operation of the electron gun 22 and the "ultor anode" of cathode ray tube 10 is supplied through conductor 34, indicated as being connected to anode button 36. Anode button 36 makes internal contact with a thin, electrically conductive coating 38 indicated as being deposited on the inner surface of funnel 14.

Means 39 for adjusting the current of beam 23 is indicated highly schematically by a block shown as being connected to power supply 24. The current of beam 23 is normally adjusted by regulating the bias of a control electrode (not shown) of electron gun 22. It is noted that all components and circuits are thus indicated highly schematically as their purpose and function is well known to those skilled in the art.

A beam deflection yoke 38 provides for scanning beam 23 across the screen 20; scanning provided is both horizontal and vertical. Yoke 38 is indicated as being connected to raster scanning circuit 40 which provides for vertical scanning, and circuit 42 which provides for horizontal scanning.

The raster scanning circuits 40 and 42 are adaptable to overscan beam 23 both vertically and horizontal to scan the entirety of screen 20. Such overscanning is necessary as it is important that the entire phosphor-bearing screen be uniformly burn-disclosed throughout at least in the visible portion of the screen, according to the invention; otherwise, a perceptibly darker rectangular pattern of standard three to four aspect ratio will be formed on the screen.

Conditioning the screen is accomplished by overscanning the entirety of the screen both horizontally and vertically. Overscanning of the vertical scanning circuit is accomplished by rotating the standard vertical size control knob of the monitor or television set which adjusts the scanning amplitude of the conventional vertical scanning circuit. The vertical scanning is preferably adjusted to a point where the raster just overscans the screen.

Figure 2:
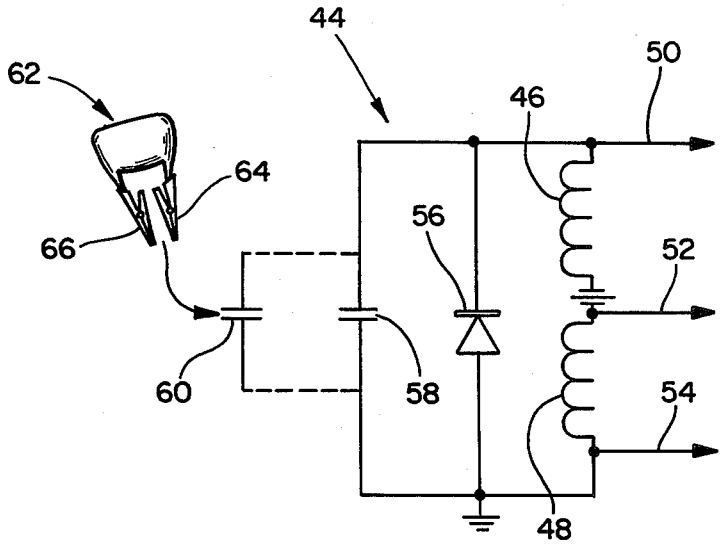
Fig. 2 PRIOR ART
FIG. 2 is a schematic diagram of means for modifying a standard electronic circuit for implementing the process according to the invention.

Many ways to provide for overscanning in the horizontal direction will occur to those skilled in the art. One example is shown by FIG. 2 wherein a section of one well-known type of electron beam raster scanning circuit is shown.

Circuit 44 is depicted as including a linearity coil 46 in series with a width adjustment coil 48. Conductor 50 of the linearity coil is routed to the horizontal sweep circuit, while conductor 52 and 54 are routed to the yoke 38 of the cathode ray picture tube 10.

Coils 46 and 48 are indicated in this typical sweep circuit as being in parallel with a damping diode 56 which provides for hindering oscillation, or "damping" the circuit. Diode 56 is in parallel with a capacitor 58 which contributes to the damping function of diode 56. The value of capacitor 58 may be, for example, 0.018 microfarads.

Overscanning is accomplished, by way of example, by installing a capacitor 60 in parallel with damping capacitor 58. Capacitor 60 may have a value equivalent to the value of capacitor 58; that is, 0.018 microfarads. Since the installation is a temporary one to provide raster overscanning for the purposes of the inventive process, the capacitor 60 may be fabricated according to the realization 62 depicted adjacently, wherein the capacitor is equipped with alligator clips 64 and 66 for clipping to the leads of capacitor 58, which is normally installed on a printed circuit board.

In essence, tube 10 is an article of manufacture comprising a cathode ray tube having a glass face panel with a cathodoluminescent screen on the inner surface thereof. The screen has a phosphor constituent vulnerable to patterned discoloring known as character burn caused by static area electron bombardment of such time and intensity as to discolor the phosphor, but not appreciably degrade phosphor efficiency. The tube according to the invention is characterized by having a conditioned screen uniformly burned-discolored throughout at least in the visible portion of the screen to render substantially imperceptible patterned character burn resulting from subsequent use.

The process for conditioning screen 20 to ameliorate the effects of character burn comprises the following:

- Installing a beam deflection yoke 38 on tube 10 for scanning beam 23 across screen 20.
- Connecting yoke 38 to an electron beam raster scanning circuit, and adapting and adjusting the circuit to overscan beam 23 both vertically and horizontally to scan the entirety of screen 20.
- Providing beam current adjustment means.
- Activating the tube and scanning circuits.
- Adjusting the beam current intensity adjustment means to provide a current in the range of 400 to 600 microamperes, and bombarding the screen for a period of time in the range of eleven to eighteen hours.

The beam current intensity is effective to provide a screen brightness in the range of 70 to 80 foot-Lamberts, which is approximately ten times the viewing brightness of a normal display of alphanumeric characters. This level of brightness is that attained with a standard P4 phosphor as viewed through a standard face panel of forty-six percent transmission.

The process according to the invention is effective to uniformly burn-discolor the screen throughout at least in the visible portion of the screen to render substantially imperceptible character burn resulting from subsequent use.

The cause of phosphor discoloring under electron bombardment is not as yet understood. This invention recognizes that the phosphor in the initial stages of electron bombardment is more sensitive to excitation, and will exhibit clearly visible character burn. This sensitivity becomes less as excitation continues, and the discoloring becomes less apparent, although some character burning will continue throughout the life of the tube.

It is important in the preconditioning (or reclamation process) that the beam current not be at such a level as to degrade cathode efficiency. A recommended maximum cathode loading is 1 ampere/cm$^2$.

The process according to the invention is also for use in the reclamation of a cathode ray tube having a phosphor imaging screen exhibiting character burn. The process comprises the bombarding of the screen as described to render substantially imperceptible the character burn.

Figure 3:
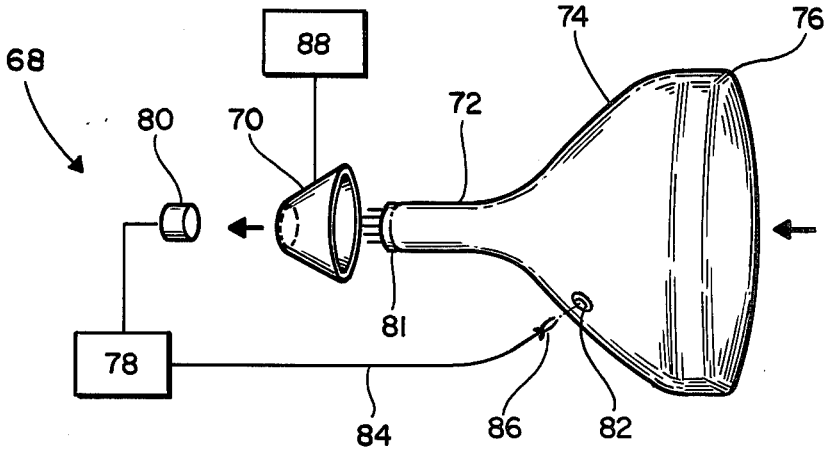
FIG. 3 shows diagrammatically a fixture useful in the process according to the invention for preconditioning and reclaiming cathode ray tubes.

The process according to the invention for ameliorating the effects of character burn may be for use in the manufacture of cathode ray tubes, and for the reclamation of such tubes after they have manifested character burn after use in a display monitor. The manufacturing and reclamation process is facilitated by the use of a simple fixture which is depicted highly schematically by FIG. 3. The fixture 68 may comprise, for example, a cathode ray tube envelope holder 70 having the form of a truncated cone conformed for accepting and cradling the neck 72 and funnel 74 of the in-process cathode ray tube 76. A power supply 78, indicated schematically by the block, supplies high voltage and low and intermediate voltages for operation of the tube 76 by connection to the socket 80 which in turn is connected to base 81. The high voltage is conducted to anode button 82 by a high-voltage conductor 84 terminated by a clip-on connector 86 for quick attachment and removal.

A standard beam deflection yoke is embodied in the cathode ray tube envelope holder 70. Raster scanning circuits 88, also represented schematically, are connected to the yoke element of holder 70 for the horizontal and vertical over-scanning of the beam.

When the process according to the invention is used in the manufacture of cathode ray tubes, the fixture 68 may be located in the production line. When the inventive process is used for reclamation of tubes having character-burned screens, the fixture can be used on a tube reclamation lines for conditioning of tubes removed from a display monitor chassis.

Figure 4:
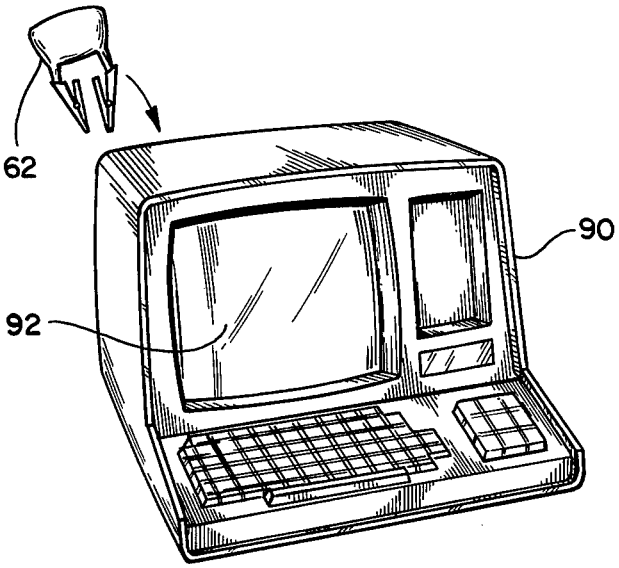
FIG. 4 is a view in perspective of a microcomputer having a cathode ray tube that can be conditioned or reclaimed by the process according to the invention.

The use of a fixture is not mandatory. For example, tubes can be conditioned or reclaimed while installed in the display monitor. An example is the video monitor which is part of the microcomputer 90 shown by FIG. 4. The cathode ray tube 92 of the microcomputer 90 can be installed and the conditioning process according to the invention can be utilized. The standard vertical size control provided in the monitor circuit can be adjusted to provide a slight overscanning in the vertical direction, and the capacitor 62, described heretofore in connection with FIG. 2, can be installed to provide for overscanning horizontally, The advantage of conditioning the screen of the installed tube is that the conditioning process can be concurrent with a normal quality control "burn-in" of the entire equipment.

Similarly, if the screen of the cathode ray tube 92 exhibits patterned discoloring resulting from use, the process according to the invention can be used to reclaim the tube without removing the tube from the display unit.

The amount of browning (or other discoloring) required to ameliorate the effects of character burn is largely a subjective conclusion. A character-burned screen is viewed through a neutral-density filter of about forty percent density, for example. If the discoloration can still be perceived, the tube is considered to be beyond reclamation.

The process according to the invention is not limited to use with a tube having a monochrome screen, as described heretofore. The inventive process is beneficial for use as well in the manufacture and reclamation of color television tubes that are vulnerable to character burn caused by static area electron bombardment. Patterned discoloring may comprise boundary lines of a video game played for a prolonged period of time, for example. Also, the repetitive patterns provided by screen text information systems such as Teletext and Viewdata may under some circumstances result in character burn.

Figure 5:
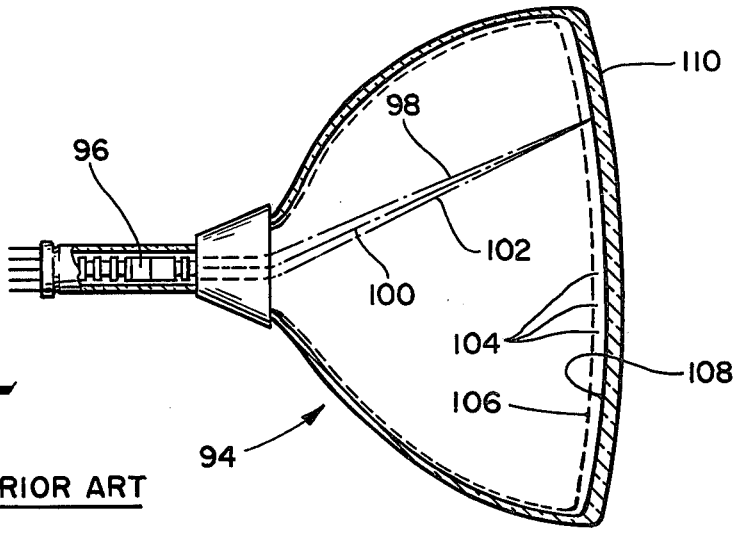
Fig. 5 PRIOR ART
FIG. 5 is a longitudinal view in section of a color cathode ray picture tube that can be conditioned or reclaimed according to the inventive process.

A color television tube subject to character burn, and to which the invention has application, is depicted in FIG. 5. The basic components of tube 94 are similar to those of tube 10 shown by FIG. 1, except that tube 94 has an electron gun 96 that provides three beams 98, 100 and 102. Each of the beams passes through associated ones of apertures 104 of a shadow mask 106 that provides for color selection. After passing through the respective apertures of mask 106, the beams fall on associated red, green or blue phosphor constituents deposited on the inner surface 108 of face panel 110, all as is well known to those skilled in the art.

The use of the process according to the invention is applicable to all types of cathode ray tube displays vulnerable to character burn including, by way of example, the beam index tube, the post-deflection focus tube, and the penetration tube, and panel displays utilizing cathodoluminescence.

While a particular process has been shown and described, changes and modifications may be made in the process without departing from the invention in its broader aspects. For examples, whereas an exemplary beam current of 400 to 600 microamperes is specified in the foregoing, the use of a phosphor other than the standard P4 may require the application of a higher or lower range of current to achieve the objectives of the inventive process. The same proviso applies to the exemplary range of time and level of brightness set forth. The aim of the appended claims is to cover all such changes and modifications as fall within the true spirit and scope of the invention.

I claim:

1. For use in the manufacture of a cathode ray tube having a glass face panel with a cathodoluminescent screen on the inner surface thereof, said screen having a phosphor constituent vulnerable to patterned discoloring known as character burn caused by static area electron bombardment of such time and intensity as to discolor the phosphor, but not appreciably degrade phosphor efficiency, a process for conditioning said screen to ameliorate the effects of character burn, the process comprising the bombarding said screen with an electron beam for a period of time and at a beam current intensity effective to uniformly burn-discolor said screen throughout at least in the visible portion of the screen to render substantially imperceptible patterned character burn resulting from subsequent use.

2. The process according to claim 1 wherein said period of time is a period in the range of eleven to eighteen hours, said beam current intensity is in the range of 400 to 600 microamperes and is effective to provide a screen brightness in the range of 70 to 80 foot-lamberts.

3. For use in the manufacture of a cathode ray tube having a glass face panel with a cathodoluminescent screen on the inner surface thereof, said screen having a phosphor constituent vulnerable to patterned discoloring known as character burn caused by static area electron bombardment of such time and intensity as to discolor the phosphor, but not appreciably degrade phosphor efficiency, a process for conditioning said screen to ameliorate the effects of character burn, comprising:

installing a beam deflection yoke on said tube for scanning said beam across said screen;

connecting said yoke to an electron beam raster scanning circuit, and adapting said circuit to overscan said beam both vertically and horizontally to scan the entirety of said screen;

providing beam current intensity adjustment means;

activating said tube and said scanning circuit;

adjusting said beam current intensity adjustment means to provide a current in the range of 400 to 600 microamperes;

bombarding said screen for a period of time in the range of eleven to eighteen hours;

said process being effective to uniformly burn-discolor said screen throughout at least in the visible portion of the screen to render substantially imperceptible character burn resulting from subsequent use.

4. A cathode ray tube conditioned in accordance with the process of claim 3.

5. For use in the manufacture of a display monitor system having a cathode ray tube including a neck, a funnel, and a glass face panel with a cathodoluminescent screen on the inner surface thereof, said screen having a phosphor constituent vulnerable to patterned discoloring known as character burn caused by static area electron bombardment of such time and intensity as to discolor the phosphor, but not appreciably degrade phosphor efficiency, said system including a magnetic deflection yoke installed on said neck of said tube in the area of the junction of the neck and funnel, said tube having at least one electron gun for producing at least one electron beam for bombarding said screen, said system including an electronic scanning circuit means connected to said yoke for the horizontal and vertical scanning of said beam and a brightness control for controlling the brightness of said image, a process for conditioning said screen to ameliorate the effects of character burn comprising:

modifying said scanning circuit to provide an overscanned beam;

turning on said monitor system;

adjusting said brightness control to provide a beam current intensity in the range of 400 to 600 microamperes;

bombarding said screen for a period of time in the range of eleven to eighteen hours;

said process being effective to uniformly burn-discolor said screen throughout at least in the visible portion of the screen to render substantially imperceptible character burn resulting from subsequent use.

6. For use in the manufacture of a color cathode ray tube having a three-beam electron gun and a glass face panel with a cathodoluminescent screen on the inner surface thereof, said screen having three color phosphor constituents vulnerable to patterned discoloring known as character burn caused by static area electron bombardment of such time and intensity as to discolor the phosphors, but not appreciably degrade phosphor efficiency, a process for conditioning said screen to ameliorate the effects of character burn, the process comprising the bombarding said screen with the electron beams for a period of time and at beam current intensities effective to uniformly burn-discolor said screen throughout at least in the visible portion of the screen to render substantially imperceptible character burn resulting from subsequent use.

7. For use in the reclamation of a cathode ray tube having a glass face panel with a cathodoluminescent screen on the inner surface thereof, said screen having a phosphor constituent exhibiting a patterned discoloring resulting from use known as character burn caused by static area electron bombardment of such time and intensity as to discolor the phosphor, but not appreciably degrade phosphor efficiency, a process for reconditioning said screen to ameliorate the effects of character burn, the process comprising the bombarding said screen with an electron beam for a period of time in the range of 11 to 18 hours and at a beam current intensity in the range of 400 to 600 microamperes effective to uniformly burn-discolor said screen throughout at least in the visible portion of the screen to render substantially imperceptible said character burn.

8. A cathode ray tube reclaimed in accordance with the process of claim 7.

9. For use in the reclamation of a cathode ray tube having a glass face panel with a cathodoluminescent screen on the inner surface thereof, said screen having a phosphor constituent exhibiting a patterned discoloring resulting from use known as character burn caused by static area electron bombardment of such time and intensity as to discolor the phosphor, but not appreciably degrade phosphor efficiency, said tube including at least one electron gun emitting at least one beam for bombarding said screen, a process for reconditioning said screen to ameliorate the effects of character burn comprising:

installing a beam deflection yoke on said tube for scanning said beam across said screen;

connecting said yoke to an electron beam raster scanning circuit, and adapting said circuit to overscan said beam both vertically and horizontally to scan the entirety of said screen;

providing beam current intensity adjustment means;

adjusting said beam current intensity adjustment means to provide a beam current in the range of 400 to 600 microamperes;

activating said tube and said scanning circuit;

bombarding said screen for a period of time in the range of eleven to eighteen hours at said beam current intensity;

such that said bombarding of said screen for said period of time and beam current intensity is effective to uniformly burn-discolor said screen throughout at least in the visible portion of the screen to render substantially imperceptible character burn.

* * * * *